United States Patent [19]

Adams

[11] 4,149,353

[45] Apr. 17, 1979

[54] WALL STRUCTURE

[76] Inventor: George C. Adams, P.O. Box 1065, Ann Arbor, Mich. 48106

[21] Appl. No.: 602,814

[22] Filed: Aug. 7, 1975

[51] Int. Cl.[2] ..... E04B 5/52

[52] U.S. Cl. ..... 52/489; 52/765; 52/775

[58] Field of Search ..... 24/81 B, 73 B; 52/489, 52/502, 509, 511

[56] References Cited

U.S. PATENT DOCUMENTS

| | | | |
|---|---|---|---|
| 656,196 | 8/1900 | Lovejoy | 24/73 B |
| 1,974,819 | 9/1934 | Koerner | 52/489 |
| 2,262,426 | 11/1941 | Hall | 52/511 |
| 2,851,740 | 9/1958 | Baker | 52/489 |
| 3,308,590 | 3/1967 | Ettore | 52/281 |
| 3,497,923 | 3/1970 | Seckerson | 24/81 B |
| 3,753,325 | 8/1973 | Stanley | 52/489 |
| 3,759,001 | 9/1973 | Judkins | 52/489 |

FOREIGN PATENT DOCUMENTS

| | | | |
|---|---|---|---|
| 501606 | 4/1954 | Canada | 52/489 |
| 1086677 | 2/1955 | France | 52/511 |

*Primary Examiner*—Price C. Faw, Jr.
*Assistant Examiner*—H. E. Raduazo
*Attorney, Agent, or Firm*—Gifford, Chandler, VanOphem, Sheridan & Sprinkle

[57] ABSTRACT

An elongated, hollow stud, or wall support member, is formed of sheet material, and has at least one longitudinally extending planar wall. The wall is formed with a longitudinally extending series of rectangularly formed holes, the holes being so aligned as to each receive a wall panel retainer so disposed therein as to effect an abutting relationship between the edges of two adjacent wall panels. The retainer has a spring tensioned clip portion removably insertable through the holes to project interiorly of the wall stud, and further has terminally formed, sharply pointed teeth, disposed exteriorly of the hole to engage an edge portion of a wall panel. Such imbed themselves in the material of the wall panel.

6 Claims, 5 Drawing Figures

WALL STRUCTURE

FIELD OF INVENTION

This invention relates to devices in the field of wall structures, and specifically relates to the combination of wall stud and wall panel retainers carried by such studs, and wall panels retained by said retainers for construction of a wall, without the need or use of nails, screws, or the like.

SUMMARY OF INVENTION

Invention resides in the provision of a spring tensioned clip portion on a wall panel retainer, and in the provision of a groove formed on said clip portion to engage a rectilinear edge of a rectangular hole receiving said clip portion to yieldably resist withdrawal of said clip portion from such hole.

Invention further resides in the provision of a pair of supporting arms flanking said clip portion, and occupying a co-planar relationship with a terminal end portion of said clip portion, when a retainer is installed in the hole.

Invention still further resides in the combination with said retainer, of a hollow, or thin walled structural stud, apertured to receive the clip portion of said retainer, whereby the wall panel may be mounted on the combined wall stud and wall panel retainer.

BRIEF DESCRIPTION OF THE DRAWINGS

This invention is attained by the disclosure hereinafter described and illustrated in the accompanying drawings, wherein.

Figure 1:
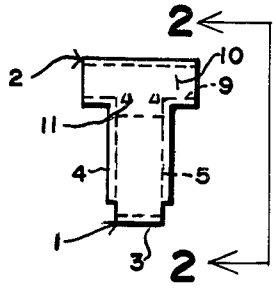
FIG. 1 is an elevational view of a wall stud, not installed in a wall, and shown 90° out of the position it would normally occupy when installed in the stud.
Figure 2:
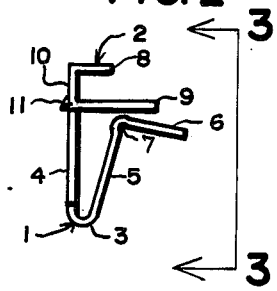
FIG. 2 is a view of said retainer taken on line 2—2 of FIG. 1.
Figure 3:
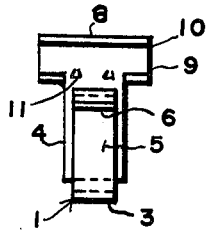
FIG. 3 is a view of said retainer taken on line 3—3 of FIG. 2.

In these views, reference character 1 designates generally the clip portion of the retainer, and the character 2 designates the wall panel holding portion thereof. The clip is formed from a blank strip of sheet material, which is bent as at 3 to constitute a first leg 4, and a second leg 5. Said legs are conjoined at the bend 3, are and disposed to occupy a divergent relationship from bend.

The second leg, 5, has its terminal end portion 6 bent approximately transversely to the plane of the second leg 5, and at the juncture of said leg 5 and said terminal portion, there is formed an offset, or groove 7.

The wall panel holding portion 2 of the retainer is formed with a plurality of sharply pointed teeth 8 bent substantially transversely to the plane of the first leg 4. The first leg 4 is substantially wider than the second leg 5, and has its marginal edge portions struck free from the blank of strip material and then bent substantially transversely to said blank to occupy a plane approximately parallel to the plane of the aforesaid teeth 8, to constitute supporting arms 9.

Figure 4:
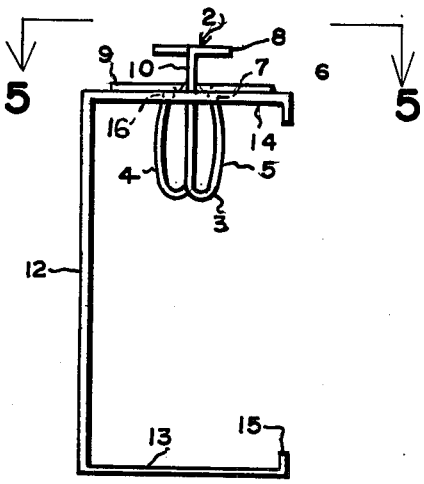
FIG. 4 is an end view, taken on line 4—4 of FIG. 5, of a thin walled stud showing two retainers in alignment, with their clip portions inserted through holes in a planar wall of the stud, and exteriorly capable of receiving wall paneling material.
Figure 5:
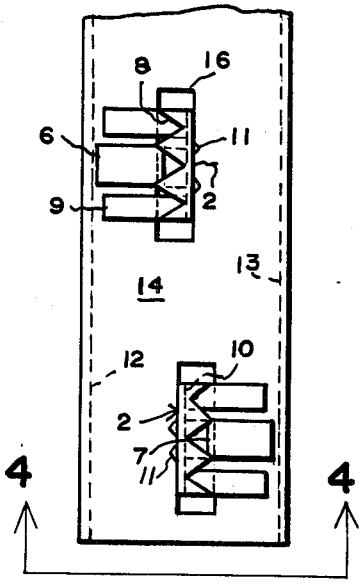
FIG. 5 is a view taken on line 5—5 of FIG. 4, and a plan view looking downwardly upon the wall-panel-holding portion of the retainer, as such retainer is shown in FIGS. 1, 2, and 3.

A cross web 10 extends contiguously with and transversely of the first leg 4, and serves to integrally conjoin the aforesaid teeth 8, and the supporting arms 9. The cross web 10 is formed with one or more strikeouts 11, the purpose of which is hereinafter explained.

it is proposed to use the above described retainer in conjunction, and in combination with, a wall stud, also formed of sheet material, and having a web 12 conjoining two flat parallel planar flanges 13 and 14. The said flanges may laterally terminate in longitudinally extending, strengthening ribs 15. The flanges 13 and 14 may both be formed with holes 16, although such holes are illustrated only in the flange 14 for purposes of example. As may be seen in FIG. 4, the clip portion of the retainer is inserted through the rectangular holes 16. The sheet material from which the retainer is formed has some spring tension, so that the legs 4 and 5 will resiliently yield toward each other as the clip portion of the retainer is forced into the hole 16.

The aforesaid groove 7 formed at the juncture of the second leg 5 and the terminal end portion 6 thereof, engages against a rectilinear edge of the hole 16, to yieldably resist withdrawal of the retainer from the hole.

The aforesaid strikeouts 11, in conjunction with the supporting arms 9, and the terminal end portion 6, serve to impart stability to the retainer, to resist any tendency of the retainer to assume an undesired attitude in the hole 16, as, by example, having the leg 4 tend to slip farther into the hole under pressure, by rocking around the aforesaid rectilinear edge of the hole as a fulcrum.

It is proposed to align the holes, in such a manner, as to receive the clips so as to attain the closest possible abutting relationship of the edge surface of a wall panel. It would be understood that the thickness of the material of the retainer, is exaggerated substantially for purposes of the accompanying drawings.

What I claim is:

1. In a wall structure, having one or more studs to support wall panels, one or more retainers receivable by the studs to retain wall panels on said studs, a planar wall extending longitudinally of each hollow stud, and one or more holes formed in said studs, each retainer being formed of yieldably resistant sheet material, wherein the improvement comprises, clip means carried by each retainer to be received in a hole, holding means on each retainer to protrude exteriorly of said hole, said holding means adapted to receive and retain an edge portion of a wall panel, said clip means being formed by return bending said blank at its central portion to form a rectilinearly extending first leg, and a second leg extending divergently from said first leg, to form a V-shaped clip, a terminal end portion of said second leg being bent approximately transversely to the plane of said second leg, to engage said wall panel, when said clip means is inserted in a hole, said hole being dimensioned to receive said V-shaped clip and urge said legs toward each other and to urge said terminal end portion of said second leg against the surface of said wall panel.

2. A wall structure as set forth in claim 1, said hole being formed with a rectilinear edge, said terminal end portion having a junction with said second leg, said second leg being offset at said junction to form a groove, to engage said rectilinear edge and resist withdrawal of said retainer from said hole, said first leg terminating in one or more pointed teeth, said teeth being bent transversely to the plane of said first leg, said teeth being engageable in wall panel material to retain a wall panel on a stud, spaced apart supporting arms formed on said first leg, said arms extending from said first leg in spaced and approximately parallel relationship to said teeth, a cross-web extending between and conjoining said teeth and said supporting arms.

3. In a wall structure as set forth in claim 2, said terminal end portion occupying a co-planar relationship between said supporting arms, and jointly engaging said planar wall with said supporting arms, when said clip is inserted in a hole in said stud, said teeth, said supporting arms and said terminal end portion all extending mutually.

4. A wall panel retainer for a wall supporting stud having a hole to receive said retainer, said retainer being formed from resilient sheet material and including, clip means carried by each retainer to be received in such hole, and holding means on each retainer to protrude exteriorly of such hole, said holding means being adapted to receive and retain an edge portion of a wall panel, said sheet material being an elongated blank, said clip means being formed by return bending said blank at its central portion to form a rectilinearly extending first leg, and a second leg extending divergently from said first leg, to form a V-shaped clip, and a terminal end portion of said second leg being bent approximately transversely to the plane of said second leg to engage said panel, said legs being urged toward each other and said terminal end portion of said second leg being urged upwardly into engagement with said panel when said legs are inserted in a hole in a stud.

5. A retainer as set forth in claim 4, said terminal end portion having a junction with said second leg, said second leg being offset at said junction to form a groove, to engage an edge of the hole in the stud and resist withdrawal of said retainer from such hole, said first leg terminating in one or more pointed teeth, said teeth being bent transversely to the plane of said first leg, said teeth being engageable in wall panel material to retain a wall panel on a stud, spaced apart supporting arms formed on said first leg, said arms extending from said first leg in spaced and approximately parallel relationship to said teeth, a cross-web extending between and conjoining said teeth and said supporting arms.

6. In a retainer as set forth in claim 5, said terminal end portion occupying a co-planar relationship between said supporting arms, and jointly engaging the wall supporting stud with said supporting arms, when said clip is inserted in such hole in such stud, said teeth, said supporting arms, and said terminal end portion all extending mutually.

* * * * *

UNITED STATES PATENT AND TRADEMARK OFFICE

CERTIFICATE OF CORRECTION

PATENT NO. : 4,149,353

DATED : April 17, 1979

INVENTOR(S) : George C. Adams

It is certified that error appears in the above-identified patent and that said Letters Patent are hereby corrected as shown below:

In the Abstract, line 13, insert --teeth--before imbed therefor.

Signed and Sealed this

*Thirteenth* Day of *January 1981*

[SEAL]

*Attest:*

SIDNEY A. DIAMOND

*Attesting Officer*

*Commissioner of Patents and Trademarks*